US006837705B2

(12) United States Patent
Sewalt

(10) Patent No.: US 6,837,705 B2
(45) Date of Patent: Jan. 4, 2005

(54) CHILD RESISTANT GAS LIGHTERS

(75) Inventor: Carel Sewalt, Oustwedde (NL)

(73) Assignee: Swedish Matach Lighters B.V., AM Assen (NL)

( * ) Notice: Subject to any disclaimer, the term of this patent is extended or adjusted under 35 U.S.C. 154(b) by 0 days.

(21) Appl. No.: 10/719,992

(22) Filed: Nov. 20, 2003

(65) Prior Publication Data

US 2004/0146824 A1 Jul. 29, 2004

Related U.S. Application Data

(63) Continuation-in-part of application No. 10/074,634, filed on Feb. 12, 2002, now Pat. No. 6,676,405.

(30) Foreign Application Priority Data

Feb. 24, 2001 (GB) ..... 0104622

(51) Int. Cl.[7] ..... F23D 11/36
(52) U.S. Cl. ..... 431/153; 431/277
(58) Field of Search ..... 431/153, 277, 431/255

(56) References Cited

U.S. PATENT DOCUMENTS 5,483,978 A * 1/1996 Doiron ..... 131/329
5,597,299 A * 1/1997 Jon ..... 431/153
5,735,294 A * 4/1998 McDonough et al. ..... 131/329
5,769,098 A * 6/1998 McDonough et al. ..... 131/329
5,957,680 A * 9/1999 Doucet et al. ..... 431/153
6,220,853 B1 * 4/2001 Luo ..... 431/153
6,485,291 B2 * 11/2002 Adams ..... 431/153
6,676,405 B2 * 1/2004 Sewalt ..... 431/153
6,695,610 B2 * 2/2004 Tsang ..... 431/153
6,716,024 B2 * 4/2004 Jon ..... 431/153
6,764,300 B2 * 7/2004 Sewalt ..... 431/153

* cited by examiner

*Primary Examiner*—Alfred Basichas
(74) *Attorney, Agent, or Firm*—Herbert Dubno

(57) ABSTRACT

A roll and press gas lighter is rendered child resistant by an impeding element (26) mounted on the lighter body such that its surface (26') is preferably substantially flush with a low friction surface (16') which forms the outer periphery of the thumbwheels (16). The impeding element preferably comprises a protective strip which extends around the sparkwheel (15). In use the engaging surface (26') of the impeding element is engaged by the user's thumb simultaneously with the low friction surface, increasing the force required to rotate the sparkwheel and hence the child resistance of the lighter. The degree of child resistance of the lighter is determined inter alia by the smoothness of the thumbwheels and the position of the impeding element.

11 Claims, 8 Drawing Sheets

CHILD RESISTANT GAS LIGHTERS

CROSS REFERENCE TO RELATED APPLICATIONS

This application is a continuation in part of Ser. No. 10/074,634 filed 12 Feb. 2002, now U.S. Pat. No. 6,676,405.

FIELD OF THE INVENTION

The present invention relates to child resistant gas lighters of the "roll and press" type.

BACKGROUND OF THE INVENTION

Roll and press gas lighters are commonly used for lighting cigarettes. They comprise a gas reservoir, a gas regulation system including a valve opened and closed by a lever, a flint, and a wheel assembly. The wheel assembly preferably comprises a sparkwheel disposed between two thumbwheels of larger diameter than the sparkwheel. The sparkwheel rubs frictionally against the flint when rotated, in order to project sparks above the opened burner and so ignite the gas, producing a flame. Such lighters traditionally include a windshield around the fuel jet, often with a tongue passing over the sparkwheel in order to avoid the user's thumb becoming soiled with flint dust. Many modern lighters also include this feature.

It is important to prevent the use of such lighters by children under the age of 5 years. The standard for child resistance has been specified in the USA by means of a functional test by the Consumer Product Safety Commission: 16 CFR Parts 1145 and 1210, Risks of Injury Associated with Lighters That Can Be Operated by Children; Safety Standard for Cigarette Lighters; Rules: Federal Register, Monday Jul. 12, 1993. The degree to which a lighter is child resistant may be objectively determined by applying the test described in these Rules and Regulations.

Two main systems are employed to make lighters child resistant. In the more common system, a blocking mechanism adjacent the lever prevents the lever from being moved into the operative position. This mechanism must be manipulated by the user each time the lighter is used, and resets automatically to the blocking position afterwards.

In the other system, the operating characteristics of the lighter are controlled so that while the lighter can be operated more easily, its successful operation is dependent on some quality of the user, such as strength, dexterity, intuition, etc., which is typical of adults but absent in small children.

The latter system is exemplified by FR 95 08011 to the present applicant, which discloses a child resistant lighter whose thumbwheels are provided with smooth peripheral surfaces. In order to engage the thumbwheels and rotate the wheel assembly, the user's thumb must apply more pressure than can be exerted by a child. However, in practice there are limitations inherent in this design.

FR A-2417722 discloses a guard which extends over the sparkwheel to improve the aesthetic appearance and protect the top part of the lighter. It also prevents contact between the user's thumb and the sparkwheel which may cause the thumb to become dirty.

U.S. Pat. No. 5,769,098 to BIC discloses a resilient guard which is mounted around the sparkwheel and projects above the thumbwheels to prevent the user's digit from reaching the wheel assembly. In order to engage the thumbwheels, the user must press hard enough on the guard to depress it.

However, it is found in practice that the protruding guard can cause discomfort for the adult user of the lighter as the pulp of the user's thumb is forced around it.

It is also found in practice that the adult user who experiences difficulty or discomfort in using a lighter will often attempt to remove the safety mechanism which causes the difficulty or discomfort, leaving the lighter vulnerable to use by children.

OBJECT OF THE INVENTION

It is accordingly the object of the present invention to provide an improved child resistant gas lighter.

SUMMARY OF THE INVENTION

According to the present invention there is provided a child resistant gas lighter including a lighter body, a lever for controlling the flow of gas from the lighter, a wheel assembly rotatably mounted on the body, and a flint cooperating with the wheel assembly for igniting the gas, the wheel assembly comprising a sparkwheel means together with thumbwheel means, said thumbwheel means including a digit engaging surface; wherein an impeding element mounted adjacent the thumbwheel means such that as the user contacts the wheel assembly, an engaging surface of the impeding element is engaged by the user's digit, and further wherein the digit engaging surface of the thumbwheel means which in use is engaged by the user's digit, comprises a low friction surface consisting of a plurality of curved surfaces.

Preferably the curved surfaces are convexly curved or dome-shaped. Preferably the impeding element comprises a protective strip. Preferably the thumbwheel means comprises a pair of thumbwheels and the sparkwheel is mounted therebetween, the protective strip extending between the thumbwheels so as to cover the sparkwheel and so prevent access to the sparkwheel by the user's digit.

Preferably the engaging surface of the impeding element is substantially flush with the low friction surface.

The present invention, in its preferred embodiment, provides a more robust and child resistant lighter which can be conveniently operated and which requires no significant learning effort on the part of the user, and ensures that the present lighter remains more reliably child resistant for the duration of its working life.

BRIEF DESCRIPTION OF THE DRAWINGS

Various lighters embodying various forms of the invention will now be described, by way of example, and without limitation to the scope of the invention and with reference to the drawings, in which.

DESCRIPTION OF THE PREFERRED EMBODIMENT

Corresponding parts are identified by the same numbers in each embodiment.

Figure 1:
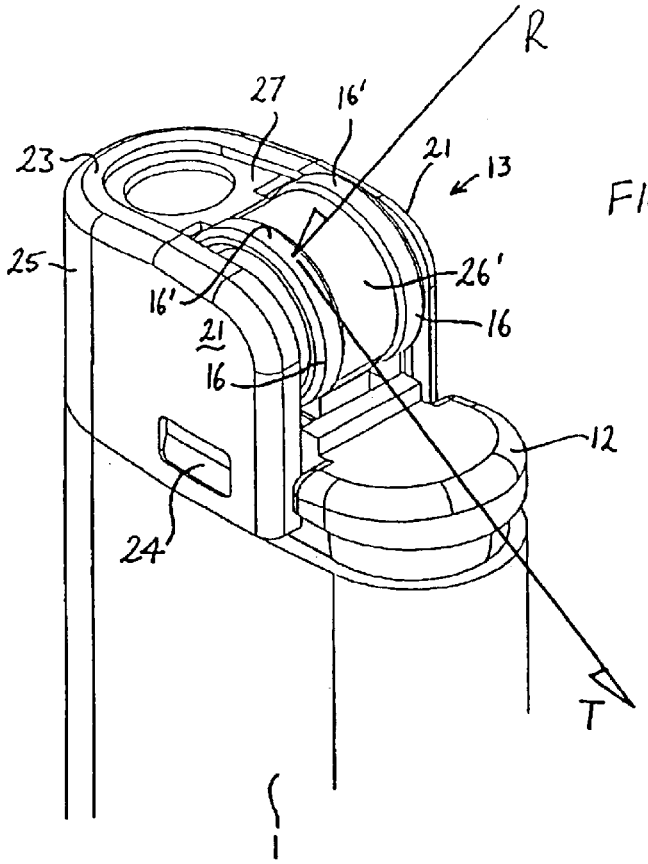
FIG. 1 shows the upper part of a first lighter.
Figure 2:
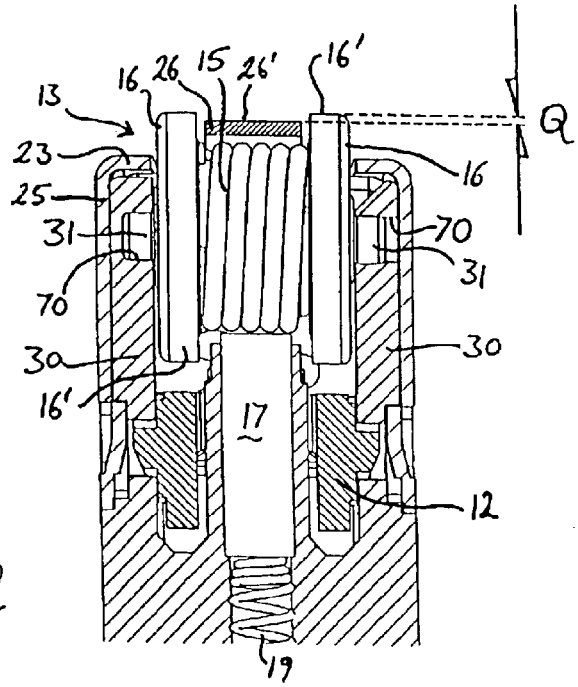
FIG. 2 is a longitudinal section through the first lighter.

Referring to FIGS. 1 and 2, the first lighter comprises a lighter body 1 containing a gas reservoir 10, a gas regulation system including a valve assembly operated by a lever 12, and an ignition mechanism comprising a sparkwheel assembly 13. The sparkwheel assembly comprises sparkwheel means, comprising a spark-wheel 15, disposed between thumbwheel means comprising two thumb-wheels 16 whose diameter is larger than that of the spark-wheel. The lighter body 1 includes a pair of upstanding ears 30 which project from each side of the body.

The sparkwheel assembly is mounted on an axle 31 rotating in a pair of holes 70 in the ears 30. The spark-wheel rubs frictionally against a flint 17 when rotated, in order to project sparks above the opened burner or jet and therefore to produce a flame. The flint 17 is urged against the spark-wheel by a spring 19. A separate windshield 25 is mounted on the body 1 around the fuel jet, and has two outer portions 21 which are located outside the thumb-wheels. A strip means 27 is also mounted on the body 1 of the lighter, adjacent the thumbwheels and supported on the ears 30, extending from one ear 30 to the other and engaging with an inside surface 22 of the windshield 25.

Figure 5B:
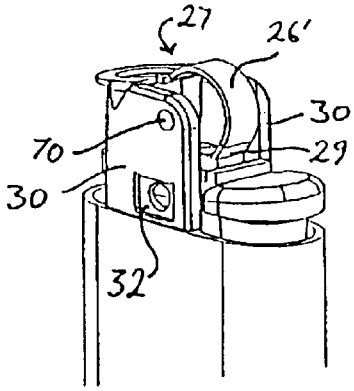
FIGS. 5A and 5B are further views of the partially assembled body of the first lighter at various stages of assembly.
Figure 5C:
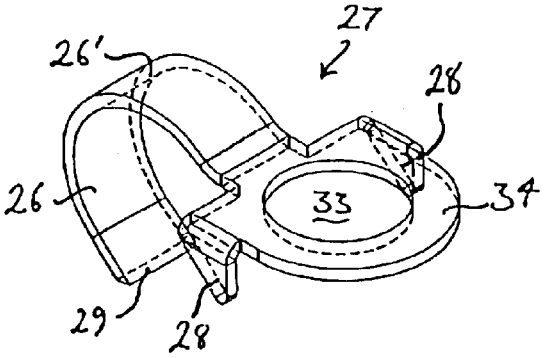
FIG. 5C shows the strip means of the first lighter.
Figure 5A:
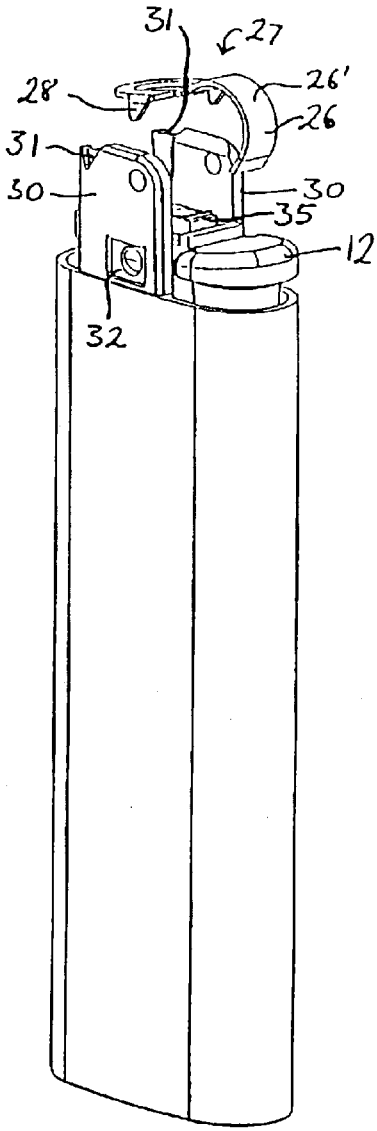

Referring now also to FIG. 5C, the strip means 27 comprises an impeding portion, comprising a substantially rigid protective strip 26, formed integrally with an annular part 34 at one end, forming a circular hole 33 through which the flame passes. The annular part 34 forms a shaped portion which corresponds with the profile of the windshield, allowing the strip means and the windshield to rigidly support each other in position after assembly and making it more difficult to disassemble the lighter. This helps to make the lighter more reliably child resistant, since it makes it more difficult for the user to remove the windshield and the strip means. The strip means also supports the ears 30, improving the strength and rigidity of the lighter.

The strip means includes two outwardly and downwardly extending lugs 28, which are located in two corresponding notches 31, one in each ear 30 of the lighter body 1, when the lighter is fully assembled. At the other end a tail 29 is provided which when assembled locates in a corresponding seat 35 in the lighter body, holding the strip 26 rigidly in position.

The substantially rigid protective strip 26 is arranged over the sparkwheel and between the thumbwheels. This protective strip 26 forms the impeding element, and its outer surface 26' thus forms the engaging surface of the impeding element which in use is frictionally engaged by the user's digit as described in more detail below. The outer peripheral surfaces 16' of the thumbwheels are smooth; that is without a substantial surface pattern, and circular in profile, but including a plurality of curved surfaces. These surfaces 16' together form the digit engaging surface, which is a low friction surface. In use, the digit engaging surface is contacted by the user's digit simultaneously with the engaging surface of the impeding element in order to rotate the wheel assembly and ignite the lighter.

It will be noted that in this preferred embodiment the outer surface 26' of the impeding element is substantially flush with the low friction surface 16'. In this specification, "substantially flush" is defined as where the outer surface of the impeding element is positioned from 0.5 mm outwardly of or above the low friction surface, to 1.0 mm inwardly of or below the low friction surface, within normal manufacturing tolerances. However in alternative embodiments the outer surface of the impeding element need not be flush with the outer peripheral surfaces of the thumbwheels.

For convenience, the height or depth in millimeters of the outer surface of the impeding element above or below the outer peripheral surfaces of the thumbwheels is referred to hereinafter as "Q". The value of Q for a substantially flush impeding surface will therefore be from +0.5 mm (indicating that the outer surface of the impeding element is raised by 0.5 mm above or outwardly of the outer peripheral surfaces of the thumbwheels) to −1.0 mm (indicating that the outer surface of the impeding element is recessed by 1.0 mm below or inwardly of the outer peripheral surfaces of the thumbwheels). The height or depth Q is shown in FIG. 2, and in this embodiment its value is −0.2 mm.

The lighter is operated in the same way as a conventional roll-and-press lighter, and does not require any additional conscious action by the intended user. The user merely presses his digit (usually the thumb) against the low friction surface 16' with sufficient force to grip and rotate the thumbwheels. The user's thumb then simultaneously contacts the surface 26' of the impeding element.

Figure 3:
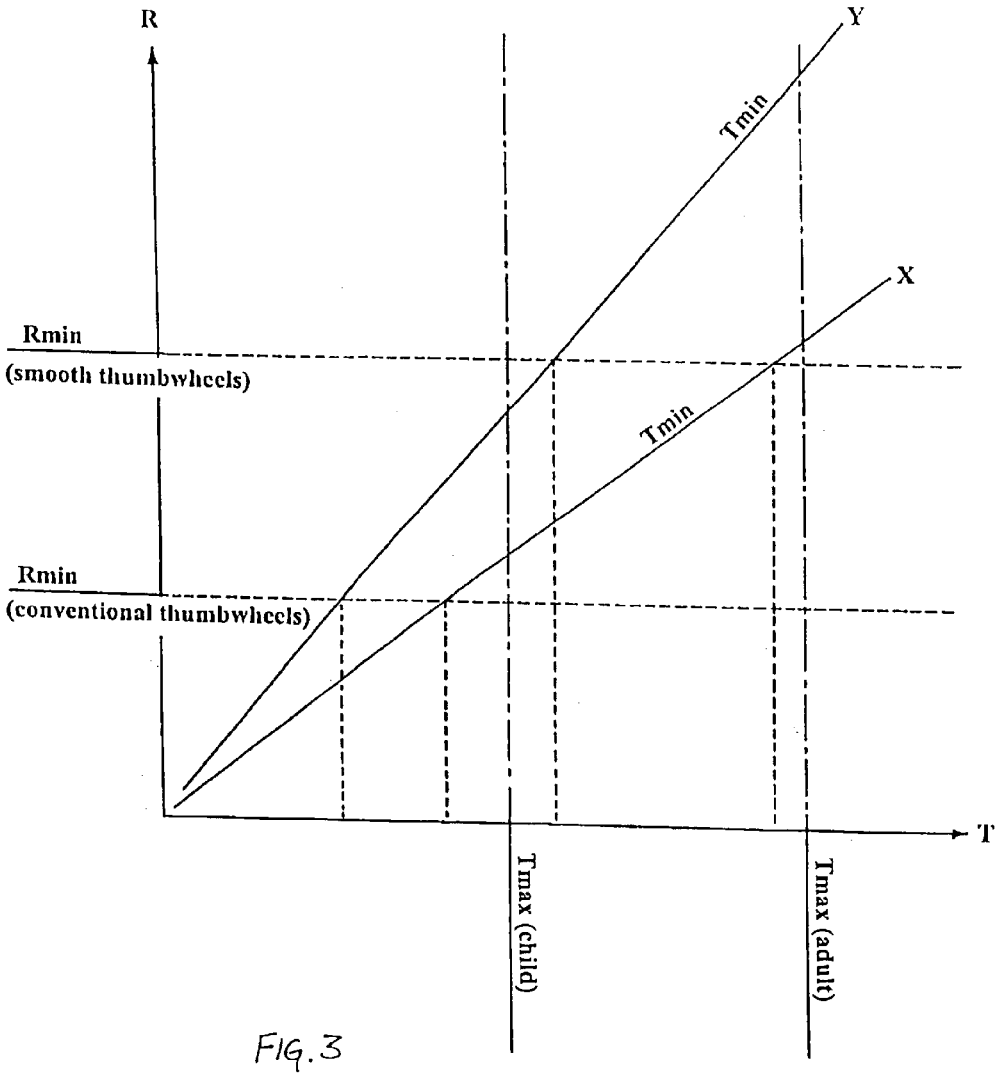
FIG. 3 is a graph representing the forces applied to the present lighter in use.
Figure 4B:
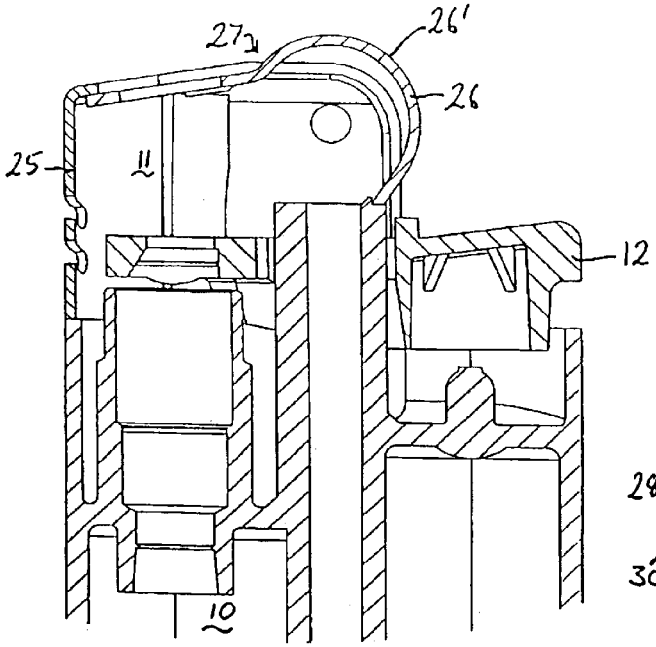
FIG. 4B is a longitudinal section along line A—A of FIG. 4A, showing the upper part of the lighter.
Figure 4C:
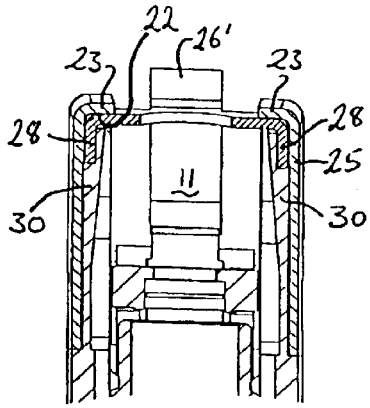
FIG. 4C is a longitudinal section along line B—B of FIG. 4A, showing the upper part of the lighter.
Figure 4A:
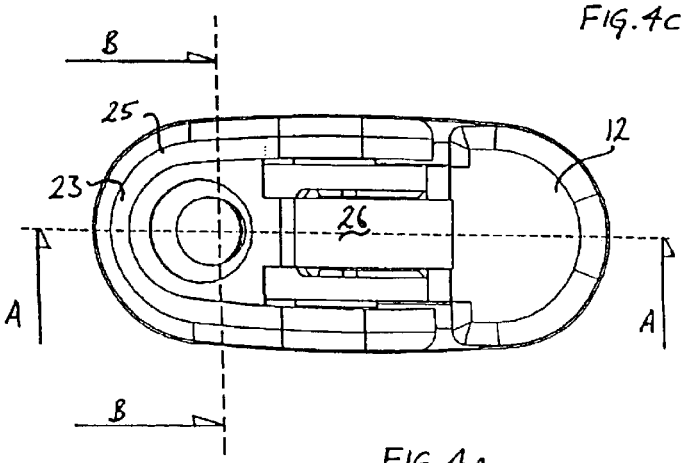
FIG. 4A is a plan view of the partially assembled body of the first lighter, showing selected components.

While this operation will be familiar to anyone who has used a conventional roll-and-press lighter, it is helpful in understanding the present invention to regard this operation as involving two forces. These are shown in FIG. 1 by the arrows R and T, representing respectively the Radial force R and the Tangential force T. Referring now also to FIG. 3, these forces may be related to each other as explained further below.

In order to operate the lighter, the user must rotate the wheel assembly fast enough to produce at least the minimum volume of sparks required to ignite the gas. In order to rotate the wheel assembly the user must first overcome the frictional resistance inherent in the ordinary construction of a roll-and-press lighter. This principally comprises the friction between the flint 17 and the sparkwheel 15, and the friction between the axle 31 and the ears 30. The user must therefore apply sufficient Radial force R, generally inwards or downwards towards the center of the wheel assembly, to achieve adequate frictional engagement between the digit and the outer peripheral surfaces 16' of the thumbwheels. This Radial force R enables him to grip the thumbwheels so as to rotate them. If he is unable to supply sufficient Radial force, his digit will slip over the surface of the thumbwheels without moving the wheel assembly fast enough to achieve ignition.

The force Rmin is therefore defined as the minimum Radial force which the user must apply in order to achieve sufficient frictional engagement between the digit and the thumbwheels to permit ignition. Many factors in the construction of the lighter will influence the value of Rmin, including, inter alia, the surface pattern and roughness of the low friction surface, the material of which the thumbwheels are made, and the width of each thumbwheel. By controlling these factors it is possible to control the value of Rmin.

In the present invention the value of Rmin is controlled in particular by the surface characteristics of the thumbwheels. In the present embodiment the surface of the thumbwheels is smooth, that is, without any substantial surface pattern, and the material from which the thumbwheels are made is chosen so as to impart the required frictional characteristic. It is found in practice that many materials are suitable for this purpose, including alloys such as Mazac and Zamac, metals, plastics, ceramics, or any other suitable material. The roughness of the low friction surface 16' is equal to or less than Ra 125 $\mu$m, which is to say, no greater than International Standard No. 630 (NEN) roughness class 1. Preferably the width of each thumbwheel is 3 mm or less. The material from which the thumbwheels are made is selected to give the desired coefficient of friction of the low friction surface, which is conveniently defined as the coefficient of friction which would exist between the said surface and itself. Preferably the coefficient of friction of the low friction surface 16' is 0.8 or less.

In alternative embodiments the low friction surface may also have an undulating profile. Alternatively the surface of the thumbwheel means may be formed with many small, rounded teeth, the low friction surface then comprising the outward tips of the teeth. In this case it is found that the radius of the projecting tip of each tooth is preferably equal to or greater than 0.3 mm. However, it has been found in tests that the objects of the present invention cannot be achieved using conventional thumbwheels having a knurled or sharp edged, serrated surface pattern, as discussed below with reference to FIG. 3.

In order to rotate the wheel assembly and ignite the lighter, after he has applied at least the minimum Radial force Rmin, the user must then apply a further force generally in the direction of rotation. This is represented in FIG. 1 by the arrow T, and referred to hereinafter as the tangential force.

As the user presses downwards on the thumbwheels, he simultaneously presses on the surface 26' of the impeding element. The degree of frictional engagement between the user's digit and the surface 26' of the impeding element is therefore determined by the value of the Radial force R. The harder the user presses on the thumbwheels, the greater the frictional engagement with the impeding element. It will be readily appreciated therefore that the present invention makes it possible by controlling the value of Rmin to also determine a minimum degree of frictional engagement which must exist between the user's digit and the impeding element before the lighter can be operated.

In order to achieve rotation of the wheel assembly and ignite the lighter, the user must overcome the frictional engagement between the digit and the impeding element. It is therefore possible to define a value Tmin, which is the minimum value of the Tangential force T which must be applied by the user in order to overcome the frictional engagement between the digit and the impeding element so as to achieve ignition. Referring to FIG. 3 it is seen that for the present lighter, the value of Tmin rises with the value of R. In other words, the harder the user has to press down on the wheel assembly to grip the smooth surface of the thumbwheels, the more resistance he must overcome from the impeding element.

For any given value of Rmin, the degree of frictional engagement between the user's digit and the surface 26' of the impeding element will be dependent on a number of factors in the construction of the lighter. These factors include, inter alia, the value of Q and the width of the impeding element and of the gap between the thumbwheels. It is found that preferably, the gap between the thumbwheels is at least 1.5 mm., and preferably the overall width of the impeding element and the thumbwheel means is less than 15 mm.

The effects of these constructional features of the present lighter are illustrated by lines X and Y in the diagram. Line X represents the value of Tmin for a lighter which has an impeding element arranged substantially flush with the surface of the thumbwheels, having a value of Q=+0.5 mm. It is seen that by providing the lighter with smooth thumbwheels, the value of Rmin is increased, and this in turn increases the value of the tangential force T which the user must apply in order to overcome the friction of the impeding element and ignite the lighter. The maximum value Tmax of the force T which may be applied by an adult is greater than that which may be applied by a child, and the abovementioned constructional features of the lighter may therefore be chosen so as to place the value of Tmin above the value of Tmax (child) and below the value of Tmax (adult). The degree of child resistance of the present lighter may therefore be readily controlled by altering the values of all or any of these abovementioned constructional features. Furthermore, the present invention may readily be applied to lighters which have different wheel assemblies offering different levels of frictional resistance to rotation.

By way of comparison, the value of Rmin is also shown for a lighter constructed in accordance with the invention, but having conventional knurled or serrated thumbwheels. It is seen that the lower value of Rmin which results from the conventional thumbwheels reduces the value of Tmin below Tmax (child); in other words, the lighter is no longer child resistant. In practice it is found that the smoothness of the thumbwheels is an essential feature of the invention.

The line Y illustrates a lighter which has a value of Q=−1.0 mm. It is seen that for a given value of Rmin, the corresponding value of Tmin is reduced. However, by providing smooth thumbwheels, it is still possible to achieve a value of Tmin which cannot be achieved by a small child, and the present lighter therefore remains child resistant even though the surface of the impeding element is 1.0 mm below the surface of the thumbwheels.

A further advantage is realized by forming the impeding element as a protective strip which extends between the thumbwheels and covers the sparkwheel. Since the strip is below the level of the thumbwheels, it is more difficult to insert a tool such as a screwdriver beneath it and thus to lever it off.

Furthermore, if excessive radial force is applied to the present lighter, the corresponding value of Tmin will be increased to a value above Tmax. The frictional engagement between the digit and the surface of the impeding element will therefore prevent the user from supplying sufficient tangential force to achieve rotation. The invention therefore requires the user to apply balanced force in the radial and tangential directions. The adult user will readily learn the required technique, using only average dexterity. However, children under five years are less able to coordinate their actions, and the presence of the impeding element together with the smooth thumbwheels therefore makes it still more difficult for a child to achieve rotation and ignite the lighter.

The smooth thumbwheels also make it more difficult to ignite the lighter by rolling it along a surface such as a carpet.

Since the child will be unable to induce the thumbwheels to move, the lighter will seem unresponsive and uninteresting and the child will lose interest in playing with it. The present invention is therefore to be preferred over systems for achieving child resistancy which allow the child to rotate the wheel assembly.

In practice both the radial and tangential forces are combined into a single movement of the user's digit. However it will readily be appreciated that by providing a combination of smooth thumbwheels and an impeding element as discussed above, the force and dexterity required to achieve rotation and ignite the lighter may be readily controlled so as to be comfortably achievable by an adult, yet unachievable by a child of under 5 years.

Since children under 5 years have very small fingers, it may sometimes be possible for a child to insert one finger between the thumbwheels of a roll-and-press lighter, and turn the wheel assembly by pressing directly on the sparkwheel. This would not impair the child resistancy of a lighter with conventional thumbwheels, but might make it easier for a small child to operate a lighter with smooth thumbwheels. By forming the impeding element as a protective strip which extends between the thumbwheels and covers the sparkwheel, the present invention also obviates this danger. The annular part 34 of the strip means also helps to prevent small children's fingers from penetrating inside the windshield in the flame orifice.

The present invention also makes it possible to adjust the child resistance of the lighter by adjusting a number of different parameters of the lighter in combination, and this allows the degree of child resistance to be more easily and accurately controlled than by adjusting any one individual feature alone.

Referring to FIGS. 4A to 5C, during automatic assembly of the lighter, the spark wheel assembly is located in the holes 70. The strip means is then placed on top of the spark wheel assembly with the lugs 28 locating in the notches 31, so that the strip means rests on top of the ears 30. The wind shield is then pressed into position surrounding the top of the valve outlet leaving a space 11 for the flame, and covering the ears 30, holes 70 and notches 31. The windshield is fixed to the body by means of indentations 24 on the windshield, best seen in FIG. 1, and corresponding indentations 32 on the ears 30 of the lighter body 1.

The windshield also comprises a rim 23 along its uppermost periphery which overlaps the projecting lugs 28 as well as the outermost edge of the strip means 27. The rim 23 serves both to retain the strip means 27 in position and also to obscure the edge of the strip means from view.

Figure 6B:
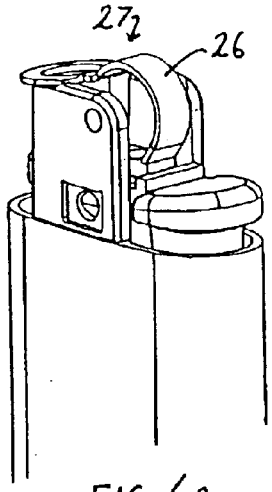
FIG. 6B shows the upper part of the second lighter at a second stage of assembly.
Figure 6A:
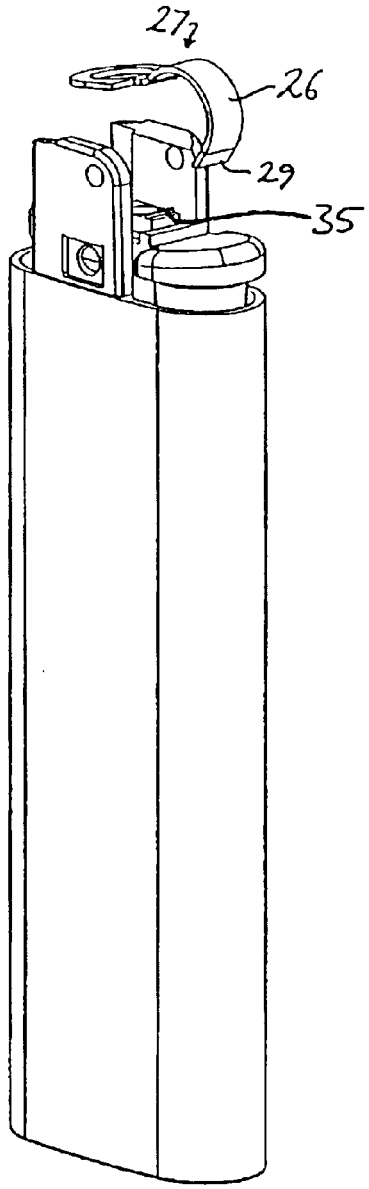
FIG. 6A shows a second lighter, showing the body together with selected components at a first stage of assembly.
Figure 6C:
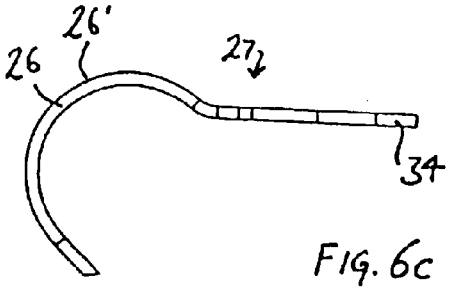
FIGS. 6C and 6D show the strip means of the second lighter.
Figure 6D:
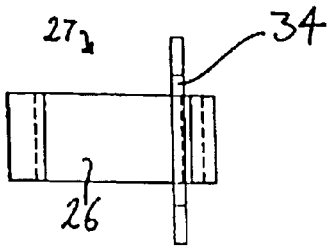

Referring to FIGS. 6A to 6C, in an alternative embodiment the strip means 27 of a second lighter is located on top of the ears 30 of the lighter body 1, but does not have the lugs 28 of the first lighter. Instead, the strip means is retained by the rim of the windshield, and by the tail 29 which when assembled locates in a corresponding seat 35 in the lighter body, holding the strip 26 rigidly in position.

Figure 7B:
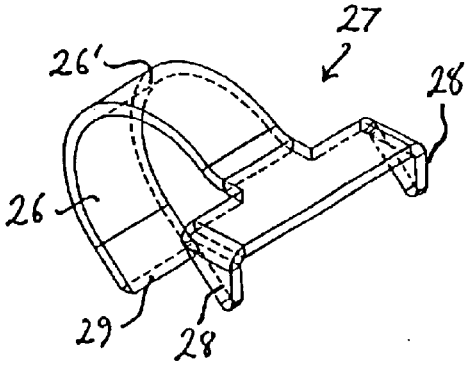
FIG. 7B shows the strip means of the third lighter.
Figure 7A:
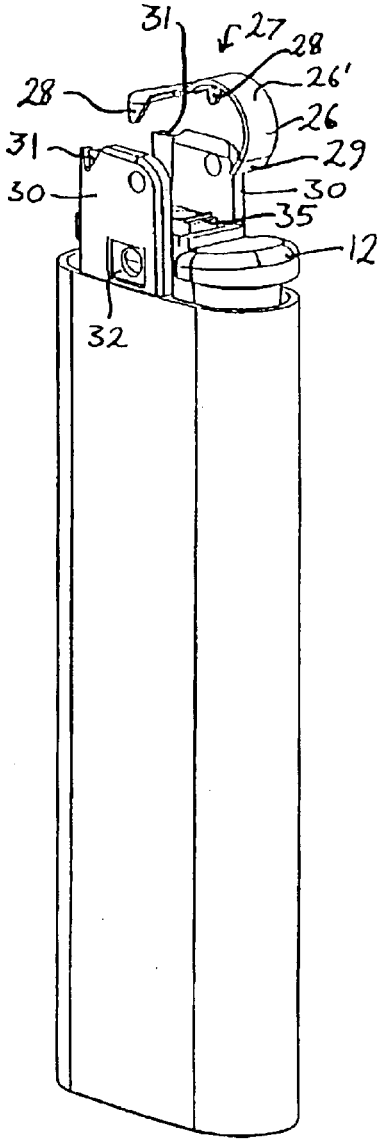
FIG. 7A shows a third lighter with the strip means excluding the curved portion surrounding the flame orifice.
Figure 8A:
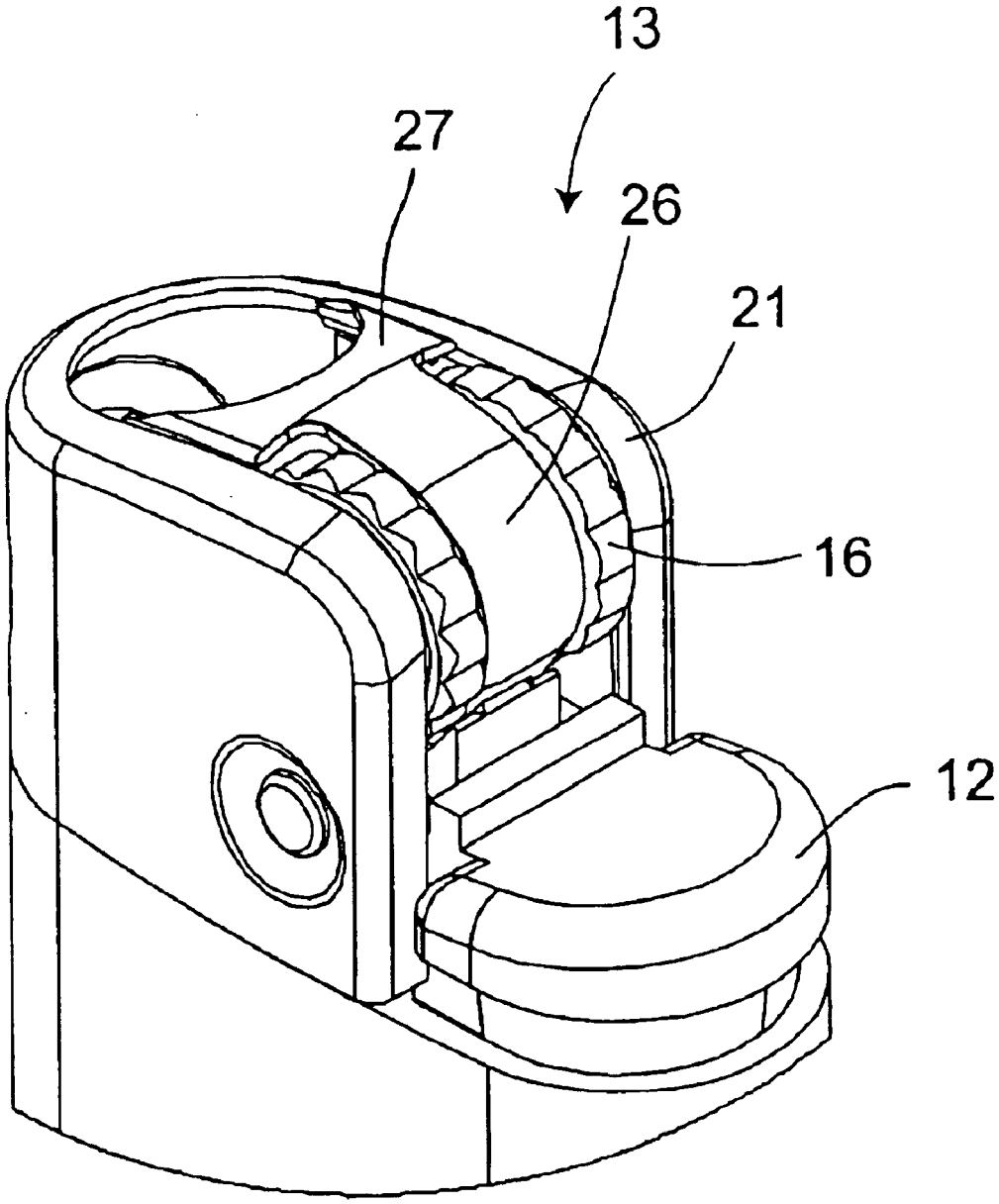
FIG. 8A shows the upper part of a fourth lighter with a thumb wheel which comprises undulations on the exterior digit engaging surface.
Figure 8B:
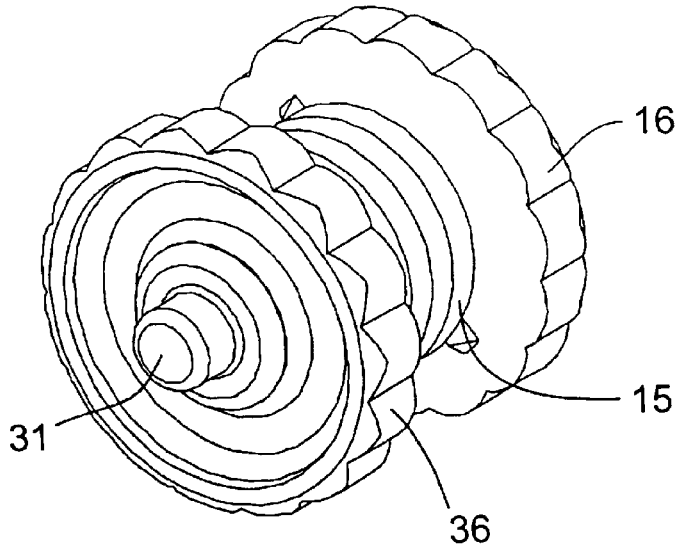
FIG. 8B shows a perspective view of the thumb wheel assembly of the lighter of FIG. 8A.
Figure 8C:
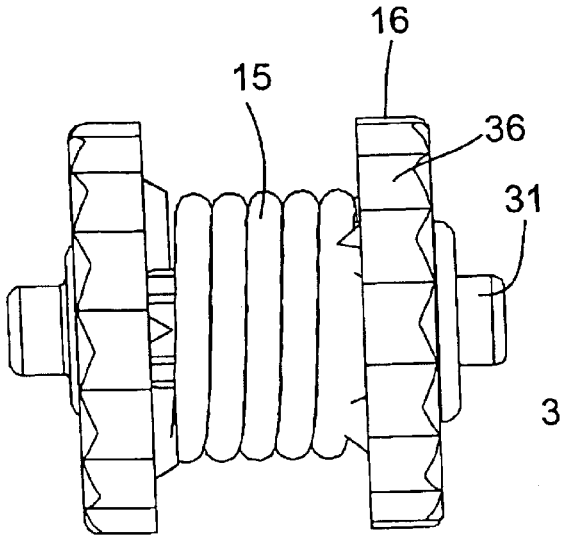
FIG. 8C shows a side view of the thumb wheel assembly of the lighter of FIG. 8A.
Figure 8D:
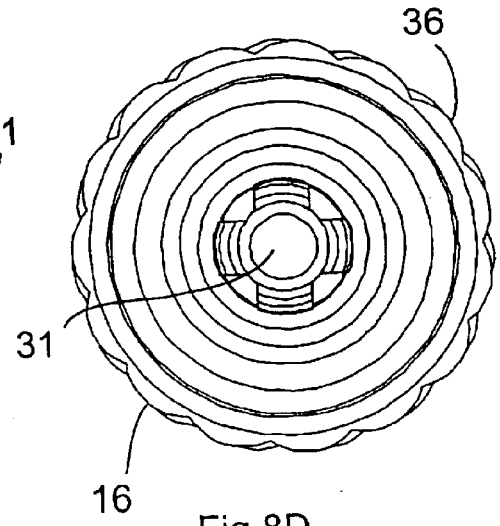
FIG. 8D shows an end view of the thumb wheel assembly of the lighter of FIG. 8A.

Referring to FIGS. 7A and 7B, in a further alternative embodiment the strip means 27 of a third lighter is formed without an annular portion surrounding the flame orifice. The assembly and operation of the third lighter are otherwise the same as described above for the first lighter.

Referring to FIGS. 8A to 8D a fourth lighter is shown in which the thumb wheel means is adapted with a plurality of smooth convexly curved surfaces 36 on the digit engaging surface 16. In this embodiment there are fifteen curved dome shaped surfaces 36 around the perimeter of the thumbwheel 16 which provide a series of convexly curved surfaces exposed to the user on the exposed portion of the thumb wheel. These convexly curved surfaces 36 are smooth and in combination with the impeding element strip 26 it has been found as with the previous embodiments that the adult users is able to operate the lighter whereas a child finds it significantly more difficult. The convexly curved surfaces 36 in this embodiment have a radius of about 1 mm. Preferably the radius of the curved surfaces should be at least 0.3 mm.

In all of the above embodiments the thumbwheel means is arranged as two wheels 16, one on each side of a central spark wheel 15 with the impeding element 26 arranged between the thumb wheels and covering the spark wheel. However, there could be only one thumbwheel rather than two. The impeding element could alternatively be arranged alongside a thumbwheel along either or both sides of it.

In a further alternative embodiment, the impeding element is formed as a separate element supported by a conventional windshield and by the lighter body. This reduces tooling and production costs. Alternatively the impeding element may be formed integrally with the windshield, which may be formed from a single sheet of metal which is suitably cut and bent.

The impeding element in the present invention maximizes user comfort. This also realizes the further advantage that since the impeding element does not cause discomfort to the user, the user will be less inclined to attempt its removal. This ensures that the present lighter remains more reliably child resistant for the duration of its working life.

Alternative embodiments using the principles disclosed will suggest themselves to those skilled in the art upon studying the foregoing description and the drawings. It is intended that such alternatives are included within the scope of the invention, the scope of the invention being limited only by the claims.

I claim:

1. A child resistant gas lighter including a lighter body, a lever for controlling the flow of gas from the lighter, a wheel assembly rotatably mounted on the body, and a flint cooperating with the wheel assembly for igniting the gas, the wheel assembly comprising a sparkwheel means together with thumbwheel means, said thumbwheel means including a digit engaging surface;

wherein an impeding element mounted adjacent the thumbwheel means such that, as the user contacts the wheel assembly, an engaging surface of the impeding element is engaged by the user's digit, and further wherein the digit engaging surface of the thumbwheel means which in use is engaged by the user's digit, comprises a low friction surface consisting of a plurality of curved surfaces.

2. A lighter according to claim 1, wherein the engaging surface of the impeding element is substantially flush with the low friction surface.

3. A lighter according to claim 1, wherein the roughness of the digit engaging surface of the thumbwheel means is Ra 125 $\mu$m or less.

4. A lighter according to claim 1, wherein the coefficient of friction of the digit engaging surface of the thumbwheel means is 0.8 or less.

5. A lighter according to claim 1, wherein curved surfaces have a top radius of 0.3 mm or more.

6. A lighter according to claim 1, wherein in that the curved surfaces are dome-shaped or convexly curved.

7. A lighter according to claim 1, wherein the thumbwheel means comprises at least one thumbwheel, and the width of the or each thumbwheel is 3 mm or less.

8. A lighter according to claim 1, wherein the overall width of the impeding element and the thumbwheel means is less than 15 mm.

9. A lighter according to claim 1, wherein the impeding element is mounted on the lighter body.

10. A lighter according to claim 1, wherein the impeding element comprises a protective strip.

11. A lighter according to claim 1, wherein the thumbwheel means comprises a pair of thumbwheels and the sparkwheel is mounted therebetween, the protective strip extending between the thumbwheels so as to cover the sparkwheel and so prevent access to the sparkwheel by the user's digit.

* * * * *